United States Patent [19]

Marchetti

[11] 4,161,138

[45] Jul. 17, 1979

[54] MACHINE FOR SEALING PARALLELEPIPED BOXES

[76] Inventor: Augusto Marchetti, Piazza Sicilia, 7, Milan, Italy

[21] Appl. No.: 889,717

[22] Filed: Mar. 24, 1978

[30] Foreign Application Priority Data

Apr. 1, 1977 [IT] Italy ..... 22013 A/77

[51] Int. Cl.[2] ..... B31B 1/60; B65G 15/00

[52] U.S. Cl. ..... 93/36.9; 198/627; 198/726

[58] Field of Search ..... 93/36.9; 198/626, 627, 198/628, 726

[56] References Cited

U.S. PATENT DOCUMENTS

| | | | |
|---|---|---|---|
| 3,170,564 | 2/1965 | Gatto | 198/627 |
| 3,491,657 | 1/1970 | Feigel | 93/36.9 |
| 3,595,369 | 7/1971 | Bowlay et al. | 198/726 |

*Primary Examiner*—Harrison L. Hinson
*Attorney, Agent, or Firm*—Karl W. Flocks

[57] ABSTRACT

This invention relates to a machine for sealing parallelepiped boxes, which comprises a support surface for the boxes and a pair of closed-loop conveyor belts located around respective successions of rollers spaced apart along the feed direction of the boxes. According to the invention, the most downstream roller of each succession has a drive shaft rotatably supported by a slide, which can be adjustably spaced along a guide transverse to the feed direction of the boxes, on said shaft there being mounted a sprocket which cooperates with the analogous sprocket associated with the other conveyor belt, with a drive sprocket disposed in proximity to one side of said support surface and rotated by a motor, and with a chain tightening sprocket disposed in proximity to the other side of said support surface, by way of a chain which engages at its opposite ends with said sprockets associated with the conveyor belts.

4 Claims, 6 Drawing Figures

MACHINE FOR SEALING PARALLELEPIPED BOXES

This invention relates to a machine for sealing parallelepiped boxes.

Parallelepiped cardboard boxes are known consisting of four vertical walls disposed at right angles, and an upper and lower group of closing flaps, each group consisting of a front flap, a rear flap and two side flaps.

When in their closed state, the configuration of said boxes is such that their end flaps have been turned over firstly into their closed position and their side flaps have then been turned over on top of said end flaps in the case of the upper closing group, and below said end flaps in the case of the lower closing group. An adhesive sealing tape is then disposed from one end wall to the other along the entire central narrow gap which divides the two overturned side flaps of each group.

For applying said sealing tape, which is usually done simultaneously on the top and bottom of the box, certain automatic sealing machines are available in which each box is fed continuously along a supporting slideway so that they pass respectively below and above two taping heads which engage respectively with the top and bottom of the box to make the seal by depositing portions of adhesive tape along the respective gaps separating the overturned side flaps.

In these sealing machines, the boxes are mostly fed by a pair of endless conveyor belts disposed at the two sides of the box and driven to engage with the side walls of the box to thrust it forward. These conveyor belts are usually supported at a distance apart which can be varied (either automatically or manually) so as to allow the machine to be adapted to the various widths of the boxes to be sealed. This gives rise to the not always easily solvable problem of supporting and driving conveyor belts which can be displaced transversely to the feed direction of the boxes.

The object of the present invention is to provide a sealing machine of the aforesaid type in which the aforesaid problem is solved in a particularly simple, robust and economical manner, while completely satisfying the requirements of maximum performance.

This object is attained according to the invention by a sealing machine comprising a support surface for the boxes to be sealed, a pair of entraining elements including conveyor belts disposed in a transversely displaceable manner at the two sides of said support surface to engage with respective side walls of the boxes in order to feed them along said support surface, and at least one taping head disposed above said support surface to apply an adhesive sealing tape to the top of the boxes as they advance along said support surface, each conveyor belt extending as an endless loop about a respective succession of rollers with their axes parallel and spaced apart along the feed direction of the boxes, of which the most downstream roller is rotated by motor means, wherein said most downstream roller associated with each conveyor belt has a drive shaft rotatably supported by a slide which can be controllably displaced along a guide transverse to the feed direction of the boxes, on said shaft there being mounted a sprocket which cooperates with the analogous sprocket associated with the other conveyor belt, with a drive sprocket disposed in proximity to one side of said support surface and rotated by a motor, and with a chain tightening sprocket disposed in proximity to the other side of said support surface, by way of a chain which engages at its opposite ends with said sprockets associated with the conveyor belts.

It will be apparent that in the sealing machine according to the invention, the problem of supporting and driving the two conveyor belts is solved in an extremely simple (and therefore economical) manner while at the same time giving maximum strength, precision and performance. In this respect, being supported by slidable slides (preferably constituted by long sleeves slidably mounted on fixed transverse bars), the belts are able to be moved in a reliable and accurate manner when required, in order to adapt their distance apart to a different box width. Furthermore, in the preferred case in which the most upstream rollers of the succession of rollers associated with the two conveyor belts are able to withdraw to a limited extent from that distance apart which is chosen for them at any particular time, and towards which they are resiliently urged, the sliding cooperation between the slides and guides prevents any undesirable torsion which would otherwise arise due to the resilient thrust exerted on said most upstream rollers when the box to be sealed is already closer to the most downstream rollers.

The chain and sprocket system used for driving the most downstream rollers of the two entraining elements, and thus the conveyor belts associated therewith, is particularly characteristic and advantageous. It is especially important that the chain be disposed so as to engage by its opposite ends with the two sprockets associated with the conveyor belts. In this respect, it not only enables said sprockets and thus the conveyor belts to be rotated in opposite directions, as requested, but also enables the tension in the chain to be kept constant for any prechosen distance apart of the conveyor belts and correspondingly of said sprockets. In this respect, when this distance is varied, the length of the chain portion between one sprocket and the other varies in the same direction, but at the same time the length of the remaining chain portion varies to an equal extent in the opposite direction, with the result that the total length of the chain and thus its tension is not caused to vary substantially. Thus the spring of the chain tightening device can be kept substantially at rest.

These and further characteristics of the present invention will be apparent from the detailed description given hereinafter of a preferred embodiment thereof illustrated by way of non-limiting example in the accompanying drawings in which.

Figure 1:
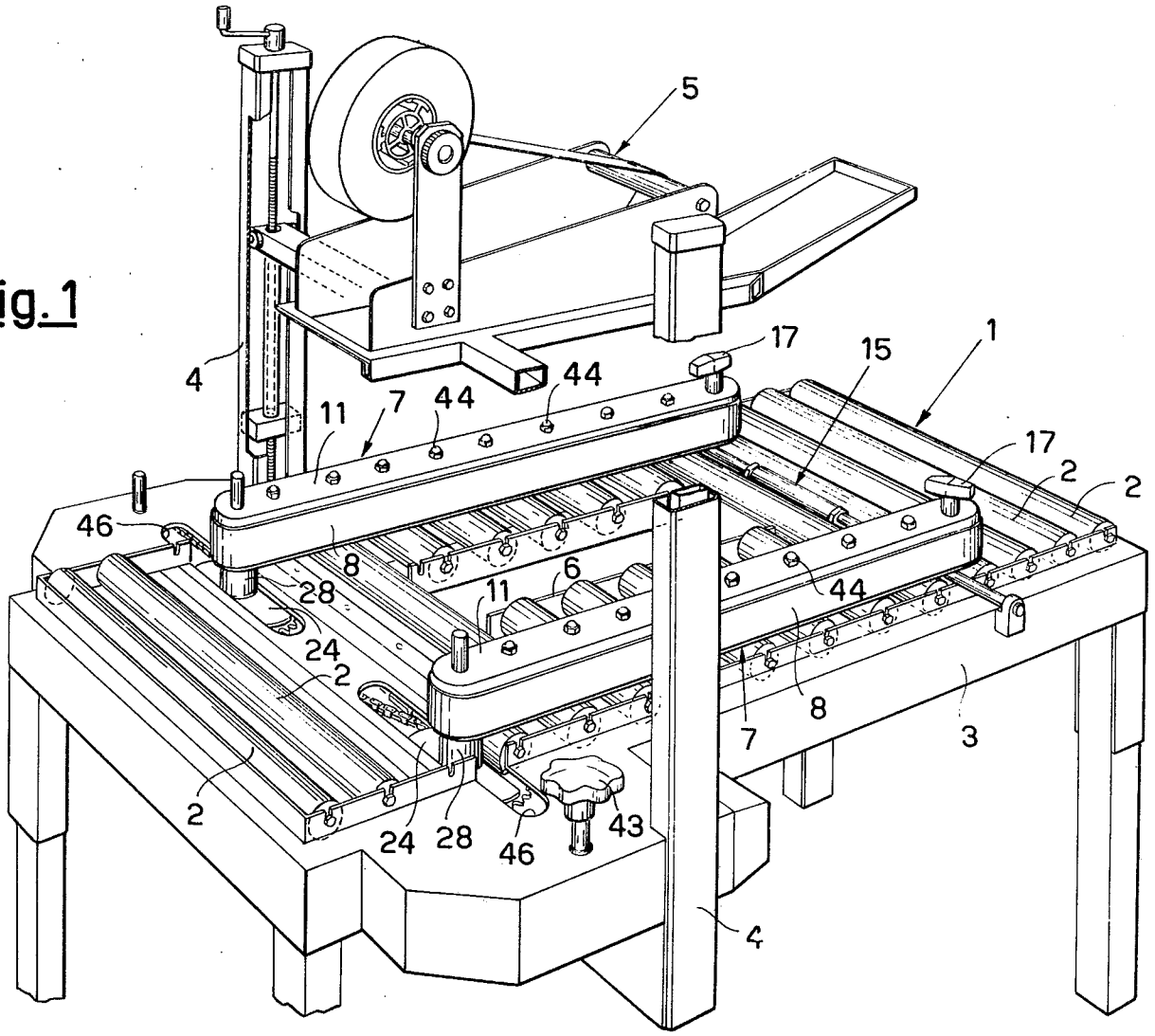
FIG. 1 is a perspective overall view of a sealing machine in accordance with a preferred embodiment of the present invention.
Figure 2:
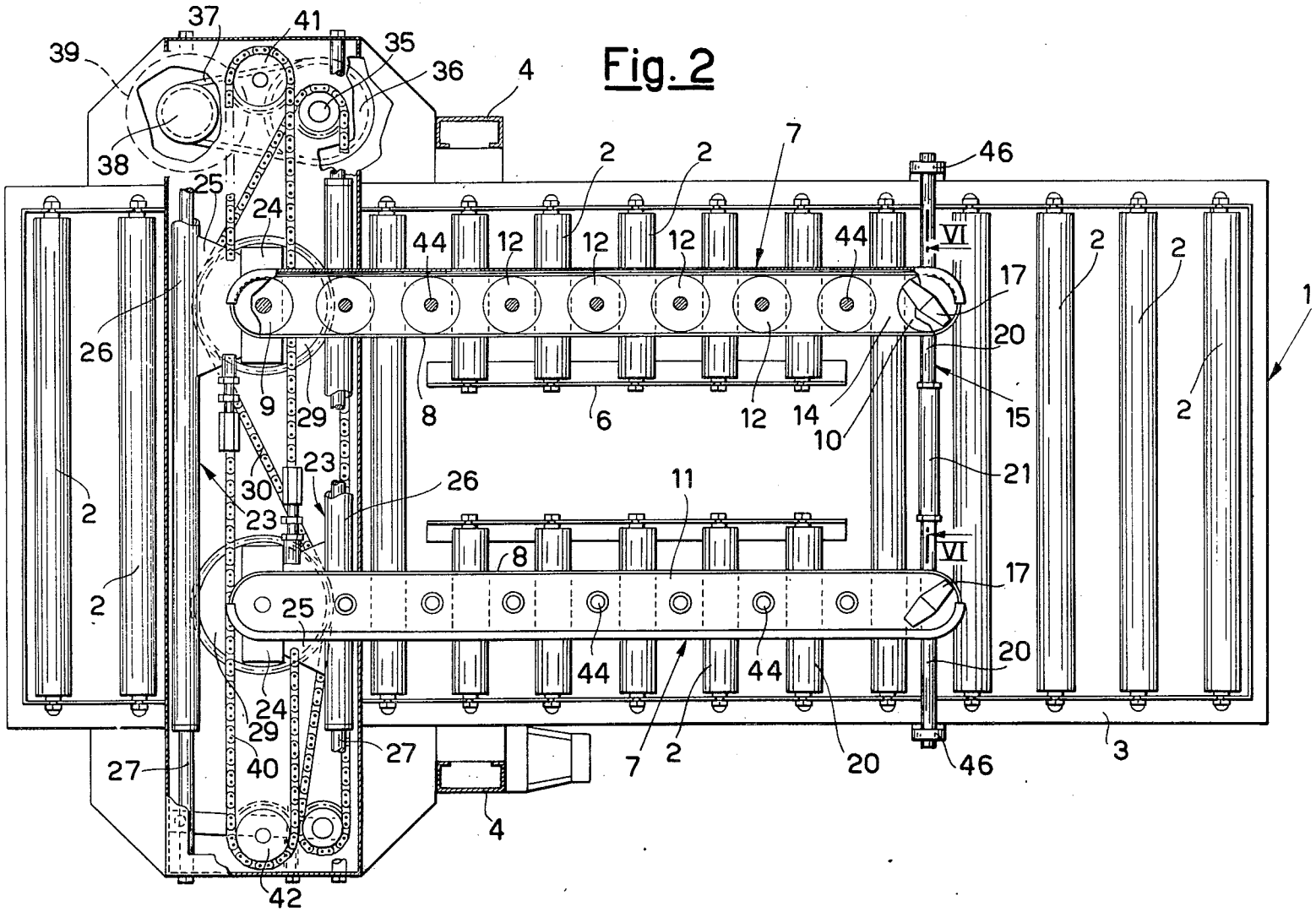
FIG. 2 is a plan view of said machine from above, with the taping head and parts of the cover removed to illustrate underlying parts.

The machine shown on the drawings comprises a support surface 1 for the boxes to be sealed, which is defined by a succession of idle rollers 2 supported by a base frame 3. Two uprights 4 (FIG. 1) support a taping head 5 at an adjustable height, and which is able to engage with the top of the boxes fed from right to left (with reference to FIGS. 1 and 2) on the support surface 1, to apply an upper adhesive sealing tape thereto. As shown in FIGS. 1 and 2, the support surface 1 comprises a compartment 6 in a position exactly corresponding with the taping head 5, and in which a further taping head can be housed for engaging with the bottom of the boxes to apply a lower adhesive sealing tape thereto.

The boxes are fed in a guided manner by a pair of entrainment elements 7 disposed in a transversely displaceable manner at the two sides of the support surface 1, and each comprising a conveyor belt 1 arranged to engage with a respective lateral wall of the box to be sealed at any given time to feed it along the support surface 1. As shown in FIGS. 1 and 2, said conveyor belt extends as an endless loop about a succession of rollers with their axes parallel, and of which the end rollers 9 and 10 act as a support for a common plate 14 which cooperates with a cover element 11 for rotatably and idly supporting the intermediate rollers 12 via pivots 44.

Figure 6:
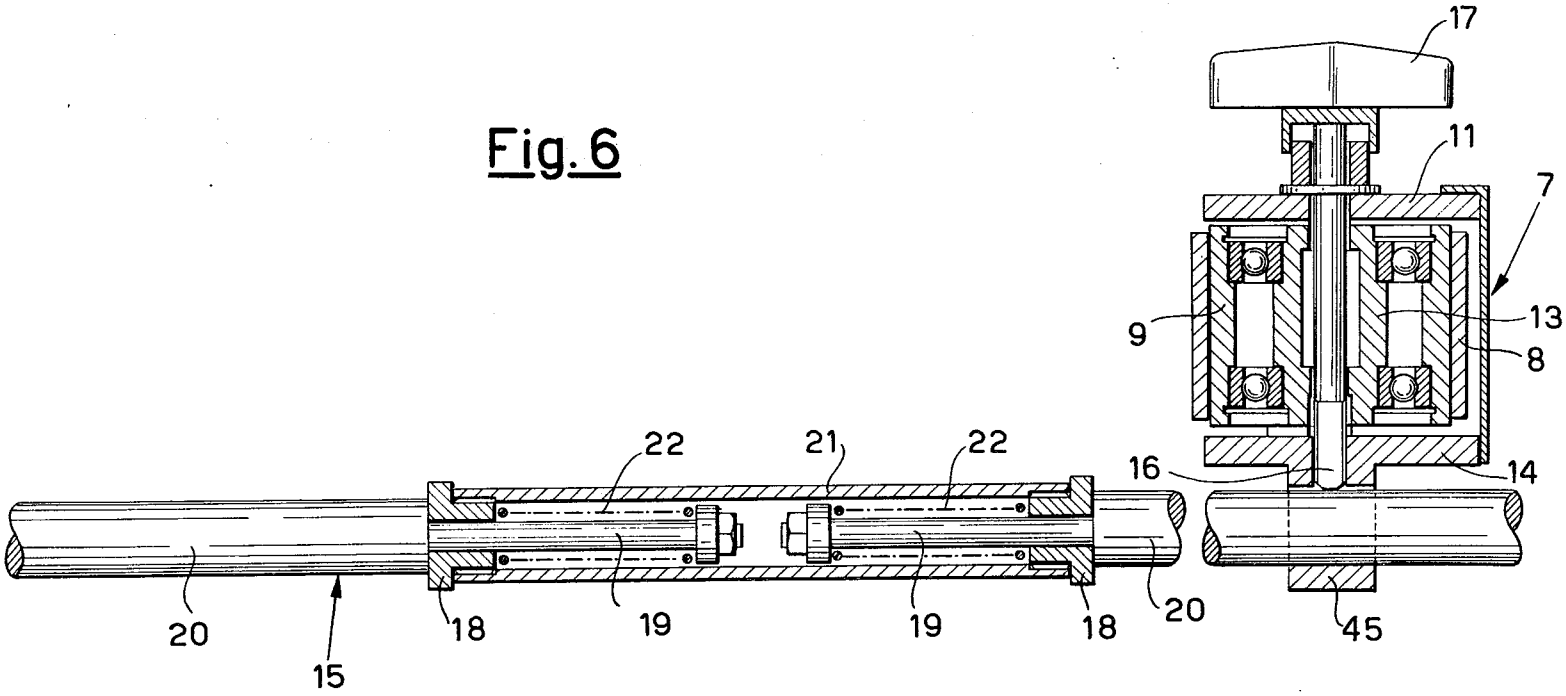
FIG. 6 is an enlarged detailed section on the line VI—VI of FIG. 2, of the support and resilient thrust system associated with the most upstream roller of the successions of rollers with which the two conveyor belts cooperate.

The roller 9, which is the most upstream of the entire succession of rollers in the box feed direction, is shown in FIG. 6 mounted idly on a central pivot 13, which is fixed to the support plate 14. This latter has an appendix 45 slidably mounted on a bar 15 disposed parallel to the idle rollers 2 of the support surface 1. A screw 16 comprising an operating knob 17 enables the support 14 and thus the roller 9 to be locked in the required position along the bar 15, according to the spacing required at any given time between the conveyor belts 8. However, said required spacing can be increased to a limited extent, to enable boxes which may be just larger than the scheduled width to enter, by virtue of the fact that extensions 19 of lateral portions 20 of the bar 15 are slidably inserted through screwed plugs 18, and return springs 22 are provided which apply an opposing force but at the same time allow the bar portions 20 to withdraw from each other to a limited extent, these bar portions being rotatably supported by fixed brackets 46 (FIG. 2).

Figure 3:
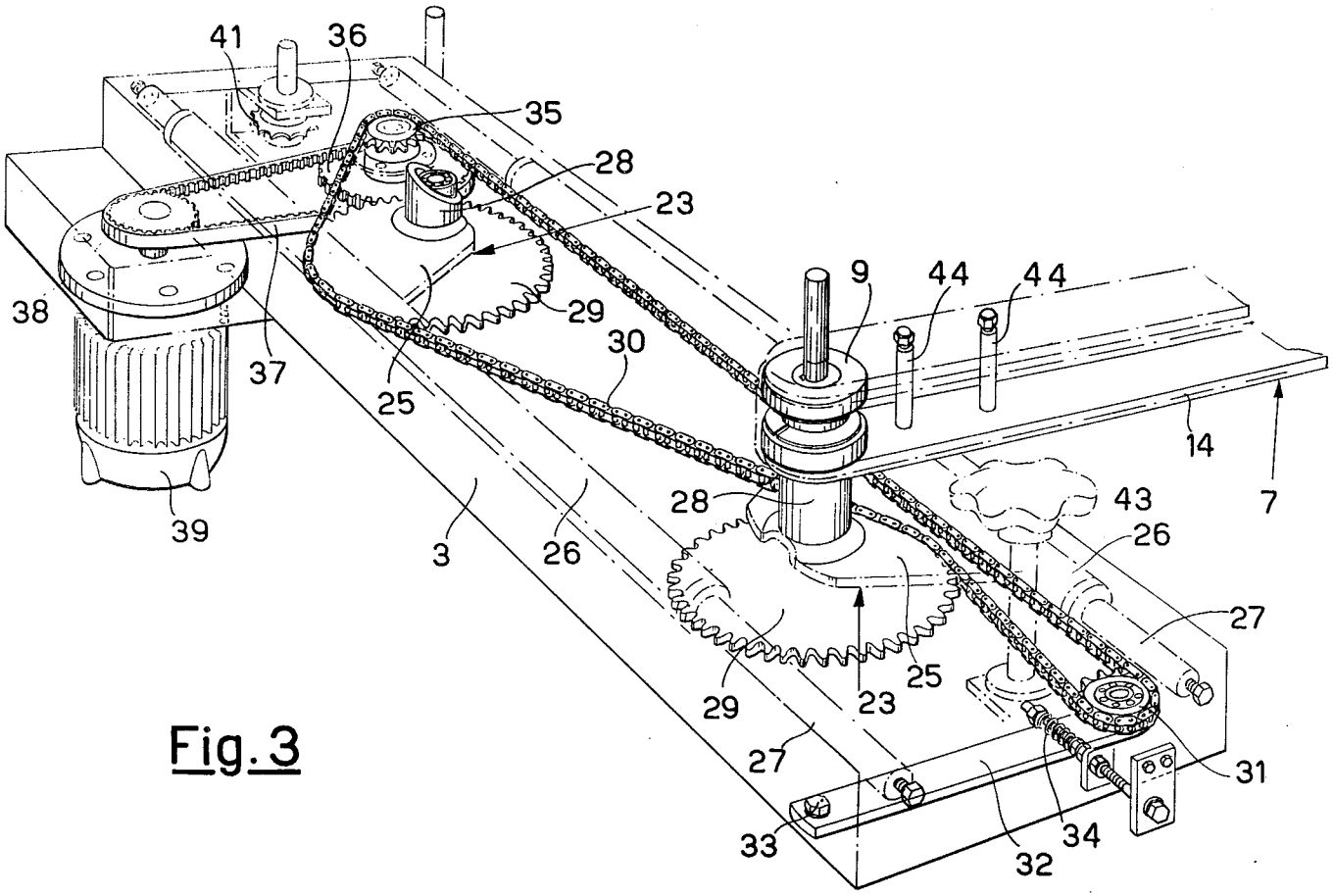
FIG. 3 is a perspective detailed view to an enlarged scale of the support and drive system for the conveyor belts.
Figure 4:
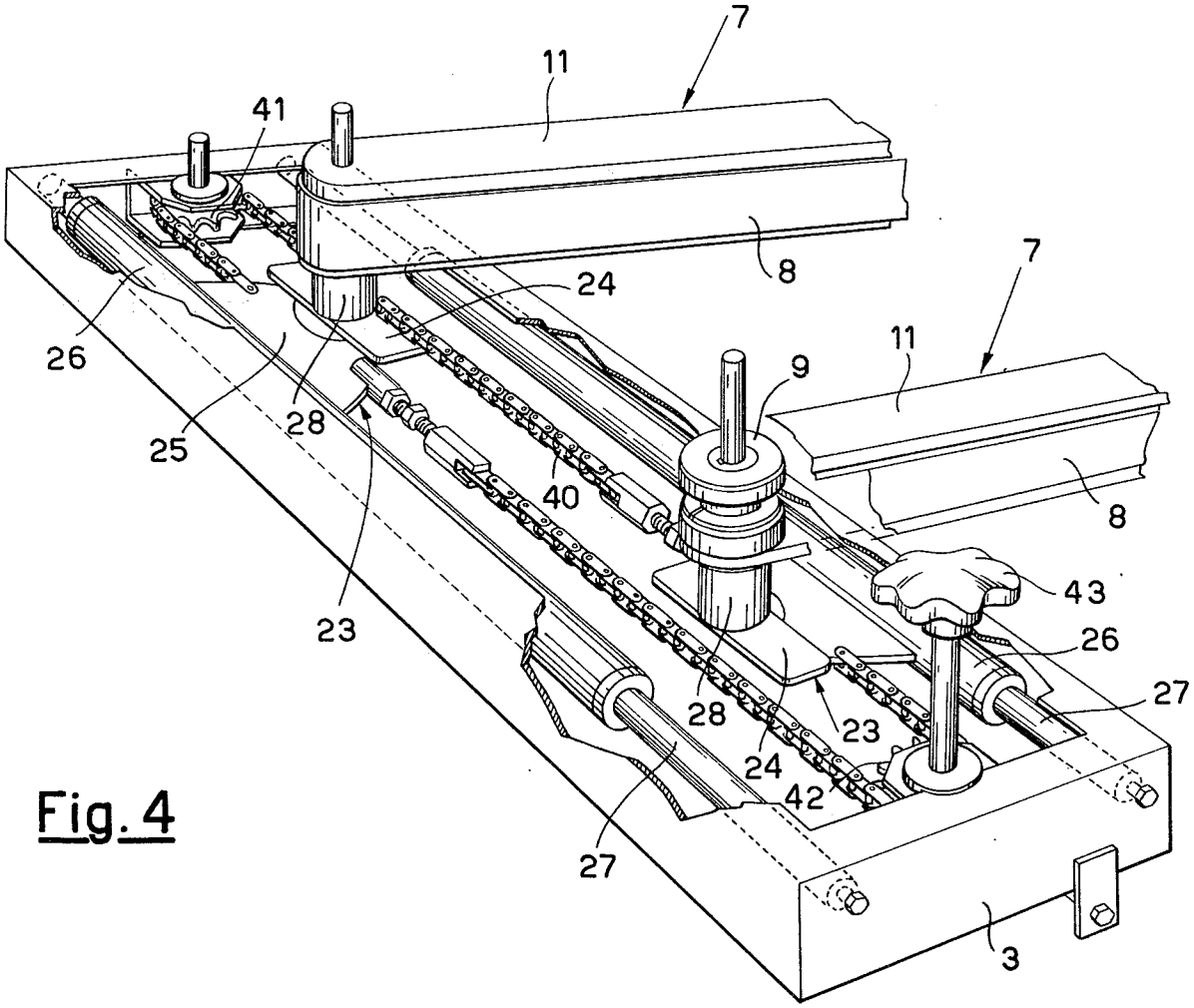
FIG. 4 is a perspective detailed view to an enlarged scale of the system for controlling the transverse displacement of the conveyor belts.
Figure 5:
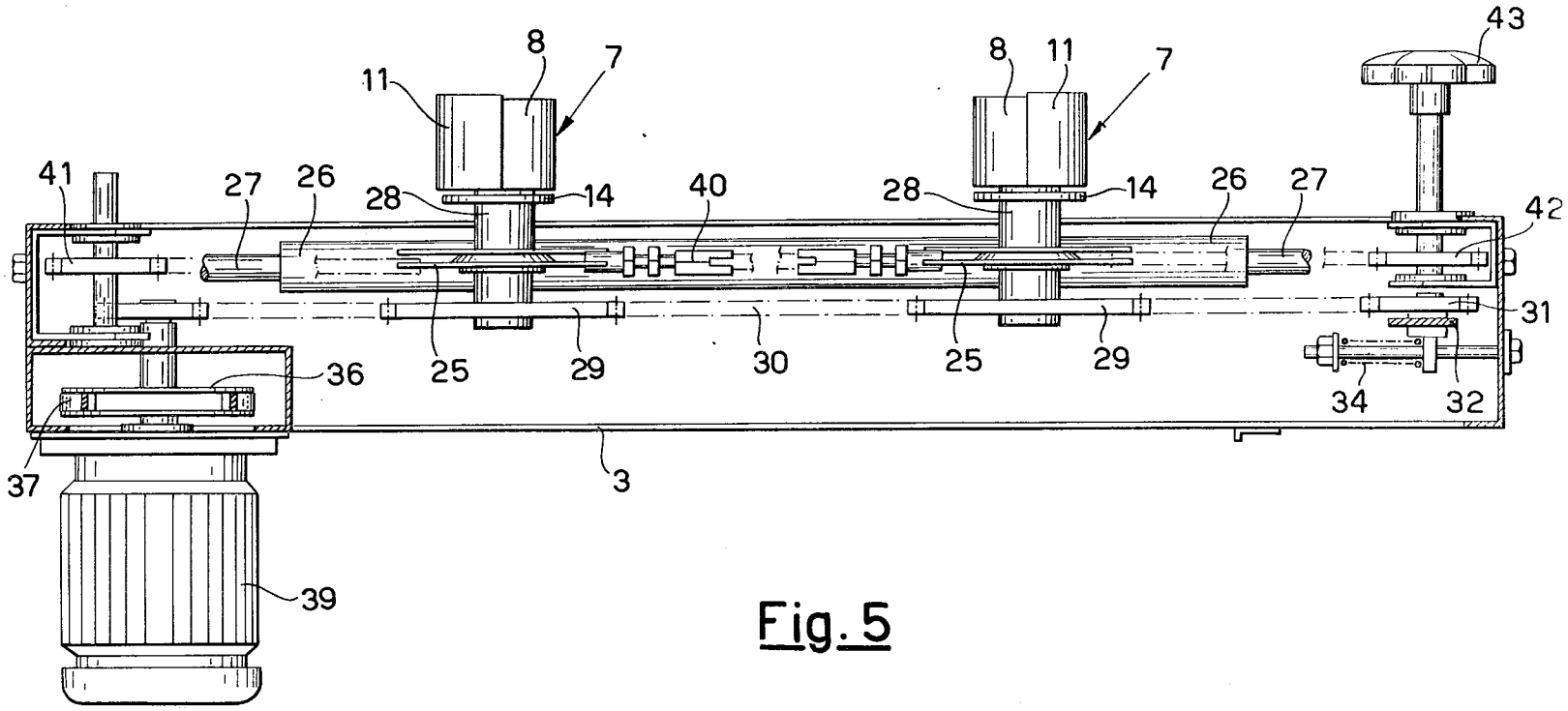
FIG. 5 is an end view, from the left hand side of FIG. 2, of the entire assembly of elements of FIGS. 3 and 4, with parts sectioned or removed.

That roller 10 which is the most downstream of the entire succession of rollers is shown in FIGS. 3, 4 and 5 rotatably mounted on a respective one of two slides 23, each of which comprises a rectangular plate 24, a triangular plate 25 and a sleeve 26 slidably mounted on a respective guide bar 27 disposed transversely to the box feed direction in proximity to the exit end of the support surface 1.

As shown in detail in FIGS. 2, 3 and 5, the shafts 28 of the two rollers 10 pass through apertures 46 in the base frame 3, and respective sprockets 29 are mounted thereon for kinematic connection by a chain 30, engaging said sprockets at opposite ends (FIG. 3), to a chain tightening sprocket 31 (mounted freely rotatable on a plate 32 pivoted at 33 to the base frame 3 and urged resiliently outwards by a spring 34) and to a drive sprocket 35. This latter is rigid with an underlying gear 36, which by means of a toothed belt 37 is coupled to a further gear 38 driver by a motor 39.

As shown in detail in FIGS. 2 and 4, the two slides 23 can be caused to slide along the respective guides 27, so that the two entraining elements 7 approach or withdraw from each other (as a function of the variable width of the boxes to be sealed), by means of an endless chain 40 which connects together the two triangular plates 25 and engages at its ends with an idle sprocket 41 and a control sprocket 42, this latter provided with an operating knob 43. By rotating this latter, the chain 40 is moved in one direction or the other, so causing the two slides 23 and consequently the two entraining elements 7 to approach or withdraw from each other, obviously after having operated the knobs 17 to make it possible for the supports 14 of the most upstream rollers 9 of said entraining elements to slide along the bar portions 40.

In operation, having determined the required distance between the entraining elements 7 by means of the knob 43 and chain 40 as already stated, and fixed the position of the supports 14 on the bar portions 40 by means of the knobs 17, the boxes to be sealed are inserted one at a time between the conveyor belts 8 and are fed by these below the upper taping head 5 and, if provided, above the lower taping head housed in the compartment 6. If a box should be slightly wider than the distance fixed for the conveyor belts 8, the two conveyor belts are enabled, because of a limited yielding of the springs 22 and a corresponding limited sliding of the bar portions 20 relative to the central sleeve 21 and to their support brackets 46, to withdraw from each other by a sufficient amount to enable the box to be inserted (possibly aided by inlet extensions shaped as lead-ins on the entraining element 7). It should be noted that the action of the compressed springs 22 results in this case in a torsional stressing of the support units for the drive rollers 9 as soon as the inserted box has exceeded half of its path between the conveyor belts 8. However, the particular configuration of these support units, and in particular of the slides 23 with their long sleeves 26 slidably mounted on the guide bars 27, prevents these stresses from resulting in actual twisting, and thus enables the entraining elements 7 to preserve their normal positioning and not suffer progressive deterioration.

To change the distance between the two entraining elements 7, the upstream rollers 9 are released relative to the bar 15 by the knobs 17, and the chain 40 is then rotated by the knob 43 to move the slides 23 to the required distance apart. It should be noted that the particular layout of the chain 30, seen in FIG. 3, means that this movement produces equal and opposite changes in the length of the portion of chain between the sprockets 29 and in the length of the remaining portion. There are therefore no variations in the level of tension of the chain 30, and the chain tightening spring 34 does not change its state.

We claim:

1. A machine for sealing parallelepiped boxes composed of two vertical side walls, two vertical end walls, a group of upper closing flaps and a group of lower closing flaps, comprising a support surface for the boxes to be sealed, a pair of entraining elements including conveyor belts disposed in a transversely displaceable manner at the two sides of said support surface to engage with respective side walls of the boxes in order to feed them along said support surface, and at least one taping head disposed above said support surface to apply an adhesive sealing tape to the top of the boxes as they advance along said support surface, each conveyor belt extending as an endless loop about a respective succession of rollers with their axes parallel and spaced apart along the feed direction of the boxes, of which the most downstream roller is rotated by motor means, wherein said most downstream roller associated with each conveyor belt has a drive shaft rotatably supported by a slide which can be controllably spaced along a guide transverse to the feed direction of the boxes, on said shaft there being mounted a sprocket which cooperates with the analogous sprocket associated with the other conveyor belt, with a drive sprocket disposed in proximity to one side of said support surface and rotated by a motor, and with a chain tightening sprocket disposed in proximity to the other side of said support surface, by way of a chain which engages at its opposite ends with said sprockets associated with the conveyor belts.

2. A machine as claimed in claim 1, wherein said slide comprises an elongated sleeve slidably mounted on a respective bar constituting said transverse guide.

3. A machine as claimed in claim 1, wherein the two support slides for the most downstream roller of the two conveyor belts are connected together by a further endless chain which cooperates with an idle sprocket and with a control sprocket such that when the latter is rotated in one direction of the other, the two slides are caused to approach or withdraw from each other respectively.

4. A machine as claimed in claim 1, wherein the most upstream rollers of the two conveyors belts are slidably mounted in a lockable manner on respective lateral portions of a bar disposed transversely to the box feed direction, said bar portions being longitudinally slidable relative to the support surface and being provided with respective facing extensions slidably inserted in a central connecting sleeve and resiliently urged towards a state of maximum mutual approach.

* * * * *